US007497593B2

(12) United States Patent
Wang

(10) Patent No.: US 7,497,593 B2
(45) **Date of Patent: *Mar. 3, 2009**

(54) ROTATIONAL OBSTRUCTION AND BEACON SIGNALING APPARATUS

(75) Inventor: Sean Xiaolu Wang, Wilmington, DE (US)

(73) Assignee: BWT Property, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/538,459

(22) Filed: Oct. 4, 2006

(65) Prior Publication Data

US 2007/0081331 A1 Apr. 12, 2007

Related U.S. Application Data

(60) Provisional application No. 60/596,631, filed on Oct. 7, 2005.

(51) Int. Cl.
*F21V 21/00* (2006.01)

(52) U.S. Cl. ..... 362/249; 362/246; 362/294; 362/800; 340/815.45; 340/983

(58) Field of Classification Search ..... 362/35, 362/477, 540, 458, 545, 218, 264, 294, 345, 362/373, 547, 249, 800, 227, 231, 235, 238, 362/239, 240, 244, 246, 311, 331, 237, 153.1, 362/153; 73/170.06; 340/982, 815.45, 983
See application file for complete search history.

(56) References Cited

U.S. PATENT DOCUMENTS

| | | | | |
|---|---|---|---|---|
| 5,313,188 | A | 5/1994 | Choi et al. | |
| 5,343,330 | A * | 8/1994 | Hoffman et al. | 359/708 |
| 5,608,290 | A | 3/1997 | Hutchisson et al. | |
| 5,808,759 | A * | 9/1998 | Okamori et al. | 359/15 |
| 6,425,678 | B1 * | 7/2002 | Verdes et al. | 362/244 |
| 6,572,249 | B2 * | 6/2003 | Bailey | 362/473 |
| 6,753,762 | B1 | 6/2004 | Jorba Gonzalez | |
| 6,902,291 | B2 * | 6/2005 | Rizkin et al. | 362/153.1 |
| 6,951,418 | B2 * | 10/2005 | Rizkin et al. | 362/559 |
| 7,357,530 | B2 * | 4/2008 | Wang et al. | 362/249 |
| 7,378,983 | B2 * | 5/2008 | Wang et al. | 340/815.45 |
| 2002/0042156 | A1 * | 4/2002 | Chen | 438/26 |
| 2002/0114161 | A1 | 8/2002 | Barnett | |
| 2002/0145533 | A1 | 10/2002 | Bushell et al. | |
| 2004/0095777 | A1 * | 5/2004 | Trenchard et al. | 362/477 |
| 2004/0246586 | A1 * | 12/2004 | Cho et al. | 359/618 |
| 2005/0156531 | A1 * | 7/2005 | Young | 315/112 |
| 2006/0132323 | A1 * | 6/2006 | Grady, Jr. | 340/815.45 |

* cited by examiner

*Primary Examiner*—Anabel M Ton
*Assistant Examiner*—Kevin J. Spinella

(57) ABSTRACT

A rotational obstruction and beacon signaling apparatus, in which chip-on-board (COB) packaged light emitting diodes (LEDs) are employed to provide a flashed emission pattern with high luminous intensity. The flash sequence of individual LEDs is controlled by an electronic timing circuit to simulate a rotational or other motional signaling effect.

15 Claims, 2 Drawing Sheets

ROTATIONAL OBSTRUCTION AND BEACON SIGNALING APPARATUS

REFERENCE TO RELATED APPLICATIONS

This application claims an invention which was disclosed in Provisional Patent Application No. 60/596,631, filed Oct. 7, 2005, entitled "Rotational Obstruction and Beacon Signaling Based on High Brightness LED". The benefit under 35 USC §119(e) of the above mentioned United States Provisional Applications is hereby claimed, and the aforementioned application is hereby incorporated herein by reference.

FIELD OF THE INVENTION

The present invention relates generally to a signaling apparatus, and more specifically to a rotational obstruction and beacon signaling apparatus based on high intensity light emitting diodes (LEDs).

BACKGROUND

Light emitting diodes (LEDs) are considered as an ideal replacement for incandescent lamps for warning and guidance signaling applications owing to their high wall-plug efficiency and long lifetime. The LED based warning and guidance signaling apparatus disclosed in prior arts employ traditional T-pack LED units with luminous intensity less than a few tens of candelas. Thus they either are limited in visibility range or require a large number (several hundreds or even thousands) of LEDs to produce the desired luminous intensity. In addition, some mechanical rotating elements are generally used to produce a rotational emission effect, which elements lack in long-term reliability. Those previous disclosures include U.S. Pat. No. 5,608,290 issued to Hutchisson et al., U.S. Pat. No. 5,313,188 issued to Choi et al., and U.S. Pat. No. 6,753,762 issued to Jorba Gonzalez, and U.S. patent application Nos. 2002/0114161 disclosed by Barnett, and 2002/0145533 disclosed by Bushell et al.

Recent development in LED technology makes it possible to deliver high lumen power in one LED unit. Such LEDs have been used for maritime signaling applications as disclosed by Trenchard et al. in U.S. patent application No. 2004/0095777. These LED units have large emission area and beam divergence angle. Thus they can not be treated as point light sources. This makes it extremely difficult for LED beam profile control. In the Trenchard patent application, the signaling apparatus comprise twelve high flux LED units and the light beam produced by the entire LED array is controlled by a specially designed Fresnel lens. This lens is both complicated in structure and difficult to manufacture. In addition, such a lens design is not suitable to produce a rotational signaling effect since the divergence angle of the LED units can not be individually controlled.

Therefore, there is a need for an improved LED warning and guidance signaling apparatus with high luminous intensity and mechanical reliability, in which the apparatus is modular designed for efficient production, configuration, and installation, as well as for precise beam property control.

SUMMARY OF THE INVENTION

According to one aspect of the present invention, the luminous intensity of the LED signaling apparatus is enhanced by adopting chip-on-board (COB) packaged high intensity LEDs, in which the LED chips are surface mounted on a thermal conductive substrate for improved heat dissipation.

The COB approach provides superior thermal control over conventional T-pack devices as the LED chips are directly attached on the substrate with their whole surfaces as the heat dissipation channel. The improved heat-sinking keeps the temperature of the LED PN junction as low as possible, which makes the LED capable of operating at much higher currents or output levels. It also leads to long lifetime as well as wavelength and intensity stability.

According to another aspect of the present invention, the light beam produced by each LED unit in the signaling apparatus is controlled individually by an optical beam transformer, which precisely defines its intensity distribution, divergence angle, and other relevant properties. The spatial distribution and angular orientation of the LED units and the corresponding optical beam transformers are precisely controlled so that the LED beams mix in a pre-determined manner to produce an emission pattern with desired intensity distribution. Such a discrete LED beam control method eliminates the need for complex lens design. It also provides the flexibility to produce relatively complex emission patterns.

According to yet another aspect of the present invention, the LED units in the signaling apparatus can operate in a time sequenced flashing mode, where the on-off status, intensity, and wavelength of the LED units are modulated in time domain. The flash sequence of the LED units is controlled by an electronic timing circuit to simulate a rotational or other motional emission effect. The flashing frequency, the intensity and wavelength variation pattern of the LED units can be programmed to achieve different motional signaling effects. The signaling apparatus comprises no mechanical moving parts, which enhances it long-term reliability.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
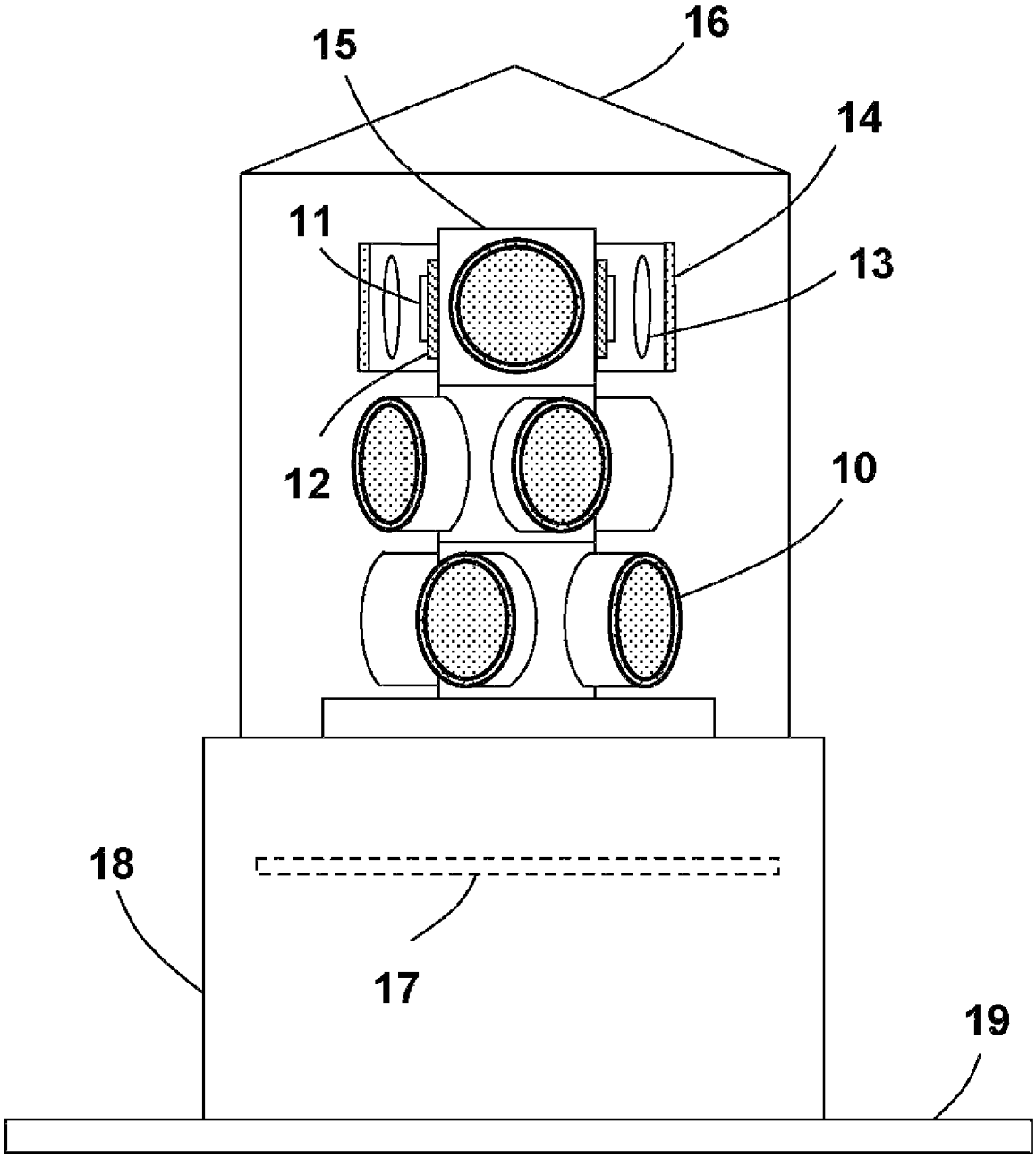
FIG. 1 illustrates the optical and mechanical structure of one exemplary LED obstruction and beacon signaling apparatus.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an LED based rotational obstruction and beacon signaling apparatus. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

One preferred embodiment of the present invention is illustrated in FIG. 1. The signaling apparatus comprises twelve high intensity COB LED units 10 mounted in three vertically adjacent stacks. Each stack comprises four LED units separated by 90 degrees (90°) angularly in the horizontal plane. A 30° angular offset is applied between adjacent LED stacks. Thus the twelve LED units can cover a 360° emission angle. Each LED unit 10 comprises one or more LED chips 11 surface mounted on a thermal conductive substrate 12, and a secondary optical system 13, preferably a non-imaging optical lens, to collect and collimate the light emitted from the LED chips 11. The collimated LED beam has a divergence angle of <10° in both the horizontal and vertical direction. The LED unit 10 further comprise a cylindrical lens array or a high-transmission holographic diffuser 14 as described by Lieberman et al. in U.S. Pat. No. 6,446,467 to homogenize and anisotropically expand the LED beam to a divergence angle of 30°×10° in the horizontal and vertical direction, respectively. The optical beam from the twelve LED units 10 thus cover a full 360° emission angle in the horizontal plane, and a small emission angle in the vertical plane. The COB LED unit in combination with the multi-stack structure makes it possible to produce a greatly improved luminous intensity. The LED beam in the present embodiment exhibits a luminous intensity of several hundred or even several thousand candelas, which enhances its visibility by an order of magnitude over the prior arts. The luminous intensity can be further increased by employing more LED units so that each LED unit operates at a smaller horizontal divergence angle. The LED units 10 may have different emission wavelengths (colors), such as red, blue, yellow or even in the infrared wavelength range for special night vision based warning and guidance signaling applications. The LED units 10 are mounted on a cylindrical shaped metal heat sink 15 for improved heat dissipation. The whole LED signaling module is enclosed in a transparent waterproof housing 16.

Figure 2:
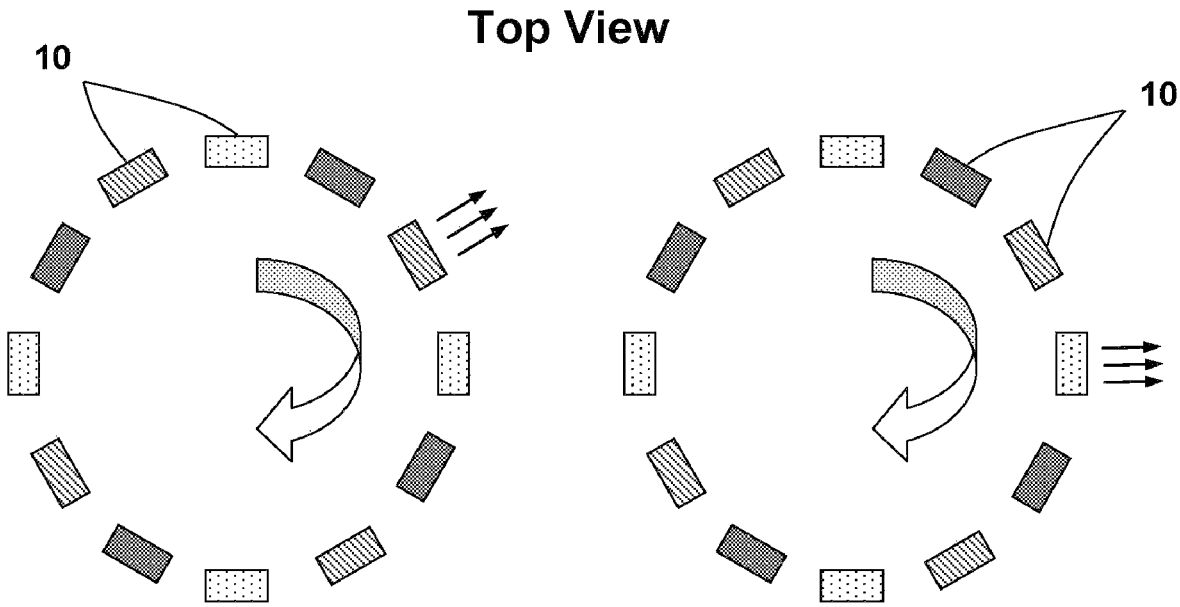
FIG. 2 illustrates one exemplary rotational flash pattern produced by the LED obstruction and beacon signaling apparatus shown in FIG. 1. LEDs in different mechanical stacks are represented by different shades in the figure.

The signaling apparatus is controlled by an electronic timing circuit 17, which can be AC, DC or battery powered. The timing circuit 17 is enclosed in an electronic compartment 18 underneath the housing 16. A base element 19 below the electronic compartment 18 is used to support the whole signaling apparatus. The timing circuit 17 controls the on-off status and intensity of individual LED units, thus generating a flash pattern. A typical flash pattern of the LED signaling apparatus is illustrated in FIG. 2, where the LED units 10 are switched on and off in a sequential manner so that a rotational emission effect is realized. LED units in different mechanical stacks are represented by different shades in the figure. Other emission patterns can be easily realized by programming the timing circuit 17 to control the LED flash frequency, duty cycle, average luminous intensity or even intensity variation profile with time. The modular design of the LED signaling apparatus make it possible to realize complex rotational signaling effects since the divergence angle and intensity distribution of each LED unit are precisely defined. The LED signaling apparatus disclosed in the present invention comprises no mechanical moving parts, which enhances its long-term reliability.

In the foregoing specification, specific embodiments of the present invention have been described. However, one of ordinary skill in the art appreciates that various modifications and changes can be made without departing from the scope of the present invention as set forth in the claims below. For example, the signaling apparatus can adopt other mechanical layouts. The holographic diffuser may be replaced by a micro-lens array. Recitations of the numerical values are illustrative rather than limiting. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An obstruction and beacon signaling apparatus, comprising:

a plurality of high intensity chip-on-board (COB) packaged light emitting diode (LED) units, being mounted on the circumference of a heat sink to produce a plurality of light beams, wherein heat produced by said plurality of LED units is dissipated through said heat sink;

a plurality of optical beam transformers, each transformer being positioned in a path of a beam among said plurality of light beams, for individually controlling a set of properties of each beam and producing a transformed light beam with high luminous intensity; and an electronic timing circuit for modulating a drive current of said plurality of LED units, such that the luminous intensity of said transformed light beams are modulated to produce a time sequenced flash pattern for long-distance obstruction and beacon signaling;

wherein each optical beam transformer among the plurality of optical beam transformers is associated with a respective LED unit among the plurality of high intensity LED units to individually control the set of properties of one associated light beam;

wherein the optical beam transformer comprises a non-imaging optical lens and an optical diffuser;

wherein the plurality of high intensity chip-on-board (COB) packaged light emitting diode (LED) units is mounted on a plurality of vertically adjacent stacks thereby producing an improved luminous intensity for the signaling apparatus.

2. The signaling apparatus of claim 1, wherein the plurality of LED units each comprising a plurality of LED chips surface mounted on a thermal conductive substrate.

3. The signaling apparatus of claim 1, wherein the optical diffuser homogenizes an intensity distribution and anisotropically controls a horizontal and a vertical divergence angle of the light beam.

4. The signaling apparatus of claim 3, wherein the optical diffuser is a holographic diffuser.

5. The signaling apparatus of claim 3, wherein the optical diffuser is a cylindrical-lens array.

6. The signaling apparatus of claim 1, wherein the plurality of LED units is adapted to produce light beams ranging from visible to infrared in wavelength.

7. The signaling apparatus of claim 1, wherein the plurality of LED units emit in multiple wavelengths.

8. The signaling apparatus of claim 1, wherein the plurality of LED units and the corresponding optical beam transformers are positioned to have different angular orientations to cover a full 360 degree (360°) illumination angle in a horizontal plane, and wherein each transformed light beam covers a predetermined illumination angle as defined by a horizontal divergence angle of the beam.

9. The signaling apparatus of claim 8, wherein the time sequenced flash pattern produced by the plurality of LED units is utilized to simulate a rotational signaling effect.

10. The signaling apparatus of claim 1, wherein the set of properties of the light beam comprise a divergence angle and an intensity distribution of the light beam.

11. The signaling apparatus of claim 1, wherein the light emitting diode (LED) units are increased on each stack such that each LED unit operates at a smaller horizontal divergence angle thereby increasing luminous intensity of the signaling apparatus.

12. The signaling apparatus of claim 1, wherein the non-imaging optical lens is positioned on the light path of each light emitting diode (LED) units to collect and collimate the light emitted from the LED at a predetermined divergence angle.

13. The signaling apparatus of claim 1, wherein a cylindrical lens array or a high-transmission holographic diffuser are positioned on the light paths of light emitting diode (LED) units to homogenize and anisotropically expand the LED beam to a predetermined divergence angle both vertically and horizontally.

14. A method for producing an obstruction and beacon signaling apparatus, comprising the steps of:

providing a plurality of high intensity chip-on-board (COB) packaged light emitting diode (LED) units, said plurality of LED units being mounted on the circumference of a heat sink to produce a plurality of light beams, wherein heat produced by said plurality of LED units is dissipated through said heat sink;

providing a plurality of optical beam transformers, each transformer being positioned in a path of a beam among said plurality of light beams, for individually controlling a set of properties of each beam and producing a transformed light beam with high luminous intensity; and providing an electronic timing circuit for modulating a drive current of said plurality of LED units, such that the luminous intensity of said transformed light beams is modulated to produce a time sequenced flash for long-distance obstruction and beacon signaling;

wherein each optical beam transformer among the plurality of optical beam transformers is associated with a respective LED unit among the plurality of high intensity LED units to individually control the set of properties of one associated light beam;

wherein the optical beam transformer comprises a non-imaging optical lens and an optical diffuser:

wherein the plurality of high intensity chip-on-board (COB) packaged light emitting diode (LED) units is mounted on a plurality of vertically adjacent stacks thereby producing an improved luminous intensity for the signaling apparatus.

15. The method of claim 14, wherein the light emitting diode (LED) units are increased on each stack such that each LED unit operates at a reduced horizontal divergence angle thereby increasing luminous intensity of the signaling apparatus.

* * * * *